United States Patent [19]

Cumming et al.

[11] Patent Number: 4,845,307

[45] Date of Patent: Jul. 4, 1989

[54] WILDLIFE GUARD FOR ELECTRICAL INSULATOR BUSHINGS

[75] Inventors: Carl P. Cumming, Southbury, Conn.; Russell H. Kraft, Hopewell Junction, N.Y.

[73] Assignee: Fargo Mfg. Co., Inc., Poughkeepsie, N.Y.

[21] Appl. No.: 267,034

[22] Filed: Nov. 4, 1988

[51] Int. Cl.[4] ..... H01B 17/58

[52] U.S. Cl. ..... 174/5 R; 174/138 F

[58] Field of Search ..... 174/5 R, 138 F, 139

[56] References Cited

U.S. PATENT DOCUMENTS

| | | | |
|---|---|---|---|
| 2,263,319 | 11/1941 | Treanor | 174/5 R X |
| 3,238,291 | 3/1966 | Bosch et al. | 174/5 R X |
| 4,234,753 | 11/1980 | Clutter | 174/5 R |

OTHER PUBLICATIONS

Advertisement: "The Squirrely", H. J. Arnett Industries, Inc., Portland, Oreg., 2 pages, Dec. 16, 1986.

*Primary Examiner*—Laramie E. Askin

*Attorney, Agent, or Firm*—Kane, Dalsimer, Sullivan, Kurucz, Levy, Eisele & Richard

[57] ABSTRACT

A wildlife guard, designed to prevent an electrically grounded animal, such as a bird or small mammal, from contacting energized electrical equipment. A one-piece construction fabricated from an insulating material, such as a high-density polyethylene, the wildlife guard can be installed on energized electrical equipment using standard live-line tools, thereby obviating the need to shut down the electrical power. The guard includes inner protrusions to fit below the topmost skirt of an insulator bushing, outer protrusions to be grabbed by a live-line tool, and a lengthwise slot through which a conductor is forced during installation.

8 Claims, 3 Drawing Sheets

WILDLIFE GUARD FOR ELECTRICAL INSULATOR BUSHINGS

FIELD OF THE INVENTION

This invention relates to insulating covers designed for the energized components emerging from electrical equipment insulator bushings. More specifically, it is an insulating cover for the bare, energized electrical conductor connected to the insulator bushing on such outdoor electrical components as transformers.

BACKGROUND OF THE INVENTION

It is often necessary to transport electrical energy considerable distances from the point of its generation to the ultimate residential or commercial customer. Generally, the greater part of the distance is taken up by high voltage transmission lines. At the generating station, voltage is stepped-up to higher values by means of transformers. By the same token, transformers are used to step-down the voltage to less dangerous levels near the point of final use. The underlying purpose of this is to reduce losses that normally would occur when transmitting electricity over long distances.

Normally, the electric utility's transformer stations are outdoor facilities and the equipment there is exposed to the elements. While such facilities must be walled or fenced-in to guard against the intrusion of unauthorized people or large animals, the accessibility of these facilities, and the equipment deployed therein, to birds and small mammals, such as squirrels, can create problems.

The most serious of these problems is represented by the strong likelihood that one of these animals will electrocute itself when, while grounded, it comes into contact with an energized conductor. While this will certainly kill the animal representing a senseless loss of wildlife, more serious, from the utility's point of view, is the short circuit that occurs in the system, causing protective circuit breakers to open. The resulting power outage, and possible damage to equipment, not only causes inconvenience to the utility and its customers, but also leads to a loss in revenue and further costs for resorting service.

A critical location on these large electrical components that is frequently involved in such occurrences is the point where a bare conductor is connected to an insulator bushing. The animal, standing atop the grounded cabinet housing the equipment, is quite frequently able to reach and touch the uninsulated conductor. A convenient path to ground through the body of the animal is thereby made available and leads to the short circuit and shut-down mentioned above.

Numerous approaches toward solving this problem have been attempted. In a sense, all have the goal of extending the distance over which insulation is provided on the conductor, thereby making it more difficult for an animal to bridge the gap between the conductor and ground with its body. Among the most elementary of these attempted solutions are insulating tape or insulating pads to cover the energized conductor. These methods are generally ineffective in providing consistent protection.

Protective covers to isolate electrically energized parts represent another approach. One of the prior art protective cover designs is a one-piece plastic unit having openings at both ends for passing a cable therethrough. One end, through which the cable exits, is conical; the other, which fits over the insulator bushing, is tubular. Among its drawbacks is that nesting insects, such as wasps and bees, can enter through the bottom and establish a colony. In the event that work later must be done on the equipment, they would have to be contended with. Equally troublesome, its one-piece construction complicates retrofitting, as the electrical connection must be opened so that the guard can be slid onto the conductor. The electrical connection must then be re-established and the guard pushed down into place.

Another prior art design is for a two-piece cover. The top of this design forms a dome having an aperture in the center thereof. The bottom is tubular in shape and has a large opening. This design also has knock-outs for limited uses. The large bottom opening and the unprotected top opening permit wasps and bees to enter and nest inside. Futher, this design is also difficult to assemble and install.

Still another prior art design provides a wildlife guard comprising a one-piece tubular body, hinged in order to open in the form of two joined semi-cylinders. The other edges of the semi-cylinders include coupling means designed to engage upon closing. There are holes at both ends to accommodate the conductor and the insulator bushing. Also included around these holes are flexible fingers, whose purpose is to prevent the entry of bees and wasps. While this device generally serves its purpose quite well, it still suffers from the drawback of being difficult to install without completely shutting the equipment down.

As can be seen from the above discussion, in this field there still remains a need for an insulating cover which is more versatile, easily installed without the necessity of shutting down the equipment, and which provides greater protection both from and to animals.

SUMMARY OF THE INVENTION

The present invention is a wildlife guard that has been specifically designed for installation with standard live-line tools. As such, the prior necessity of shutting down the electrical equipment will be avoided. The feature of the present wildlife guard which makes this installation possible is a series of three eyes or holes which can be grabbed or engaged by the tools in order to position the guard properly on the piece of equipment.

In addition, the wildlife guard of the present invention incorporates an open slot so that it can simply be pushed or pulled over the bushing and energized hardware. The three eye positions, set at approximately equal intervals around the outside of the guard, allow ready tool access regardless of the installer's position relative to the bushing.

The ease with which the present wildlife guard can be manipulated with tools at a distance has the added advantage of providing additional protection to the worker from bees or wasps which may have managed to establish a nest inside.

Further advantages will become apparent to the reader in the coarse of proceeding through the following detailed description and drawings.

DETAILED DESCRIPTION OF THE PREFERRED EMBODIMENT

The features of the wildlife guard of the present invention will be described with reference to the accompanying drawings. It should be understood that this is a description of the preferred embodiment and that a person skilled in this particular art could make obvious modifications without departing from the scope of the claims to follow.

Figure 1:
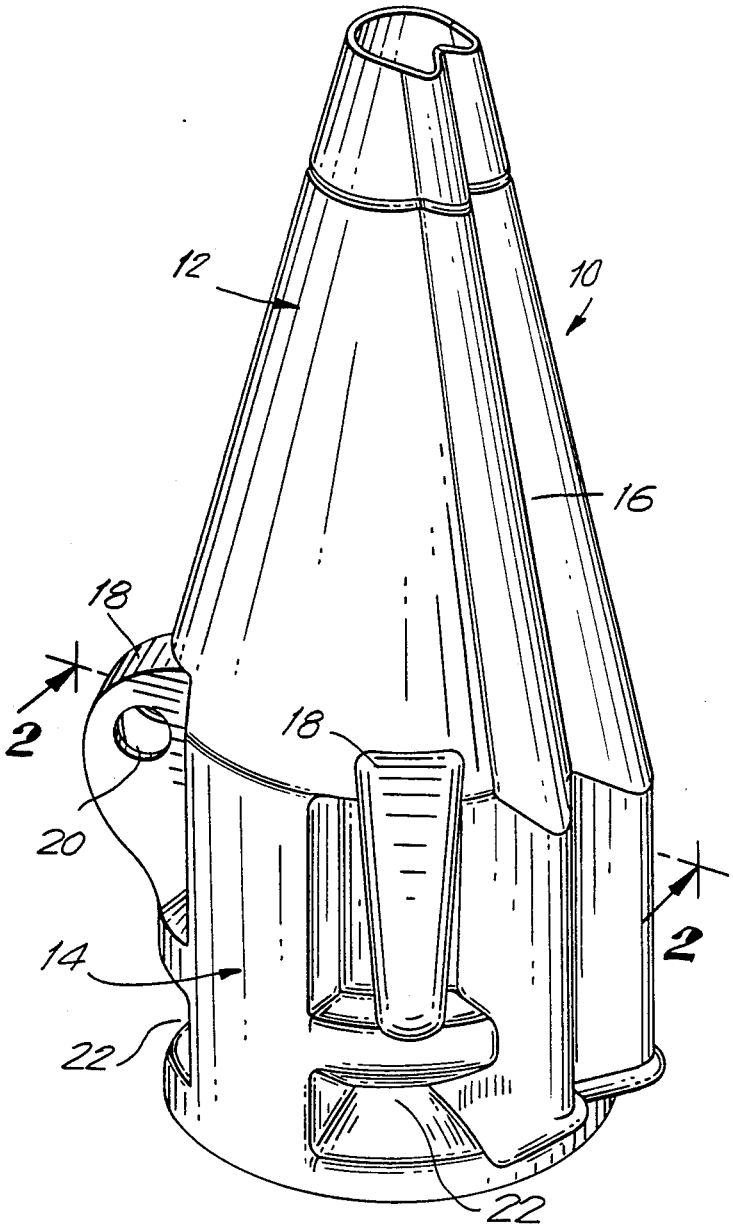
FIG. 1 is a side elevational view of the wildlife guard of the present invention.

FIG. 1 presents a side view of the present wildlife guard 10. It could be described as being integrally composed of two sections: an upper frustoconical section 12 and a lower cylindrical section 14. The diameter of the larger, lower opening of the frustoconical section 12 is identical to that of the cylindrical section 14.

The wildlife guard 10 is, of course, hollow or empty. In order to serve the purpose for which it is intended, it should be made of an electrically insulating material, such as a high-density polyethylene. An additional characteristic desired in the material used for the wildlife guard 10 is an ability to resist the deterioration brought about in some insulating materials by exposure to the ultraviolet radiation present in sunlight, as well as that due to seasonal changes in weather.

Extending longitudinally up the outer surface of the wildlife guard 10 is a V-shaped indentation 16. During the manufacture of the wildlife guard 10, a cut is made more or less following the line made by the bottom of the V-shaped indentation 16. This cut splits the wildlife guard 10 longitudinally forming a slot so that, when the V-shaped indentation 16 is pushed against or pulled into a cable, the cable will pop through the slot into the interior of the wildlife guard 10. Because of the inward orientation of the V-shaped indentation, it will be comparatively difficult to get the wildlife guard 10 out from around the conductor.

The cylindrical section 14 of the wildlife guard 10 is characterized by two other kinds of important features. The first kind may be described as longitudinally oriented outward protrusion 18. There are three such outward protrusions 18 at approximately equal intervals around the circumference of the cylindrical section 14, that is, one on each side of the V-shaped indentation 16 and a third diametrically opposed to it. Each outward protrusion 18 is pierced with a laterally oriented hole 20, which enables an appropriate live-line tool to grip and hold the wildlife guard 10 during installation or removal. The fact that there are three such protrusions 18 allows for ready tool access regardless of the worker's position.

The other kind of feature may be described as a laterally oriented inward protrusion 22. There are a total of three such inward protrusions 22—one located immediately below each of the three outward protrusions 18. Their purpose will be made clearer in the discussion of FIG. 4 to follow below.

Figure 2:
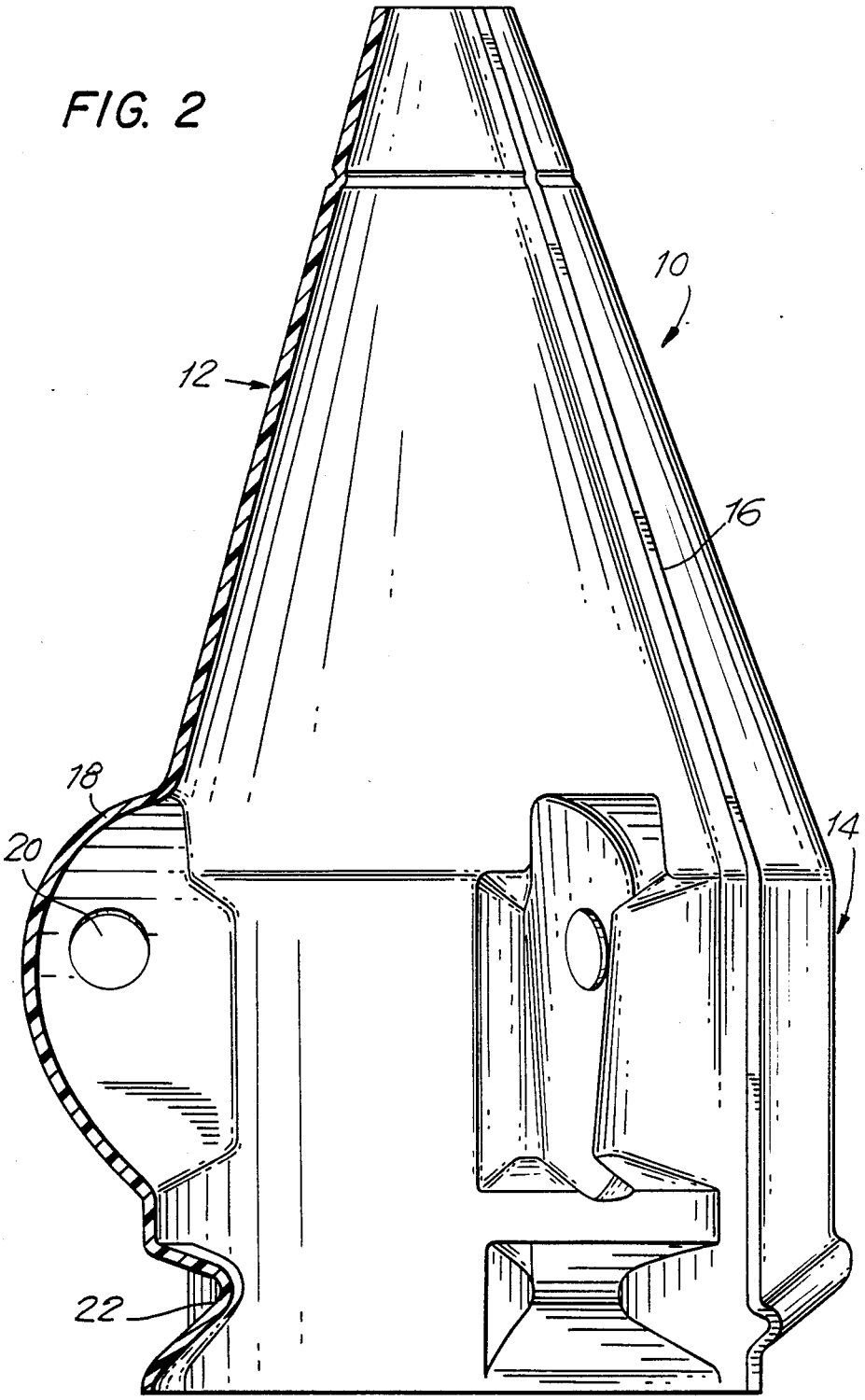
FIG. 2 is a sectional view of the wildlife guard taken along the line 2—2 in the direction shown in FIG. 1.

FIG. 2 is a sectional view of the wildlife guard 10 taken as indicated in FIG. 1 by cutting the guard 10 in half along a plane parallel to its axis. An alternate view is thereby presented for the V-shaped indentation 16, the longitudinal outward protrusion 18 with hole 20, and the lateral inward protrusion 22.

Figure 3:
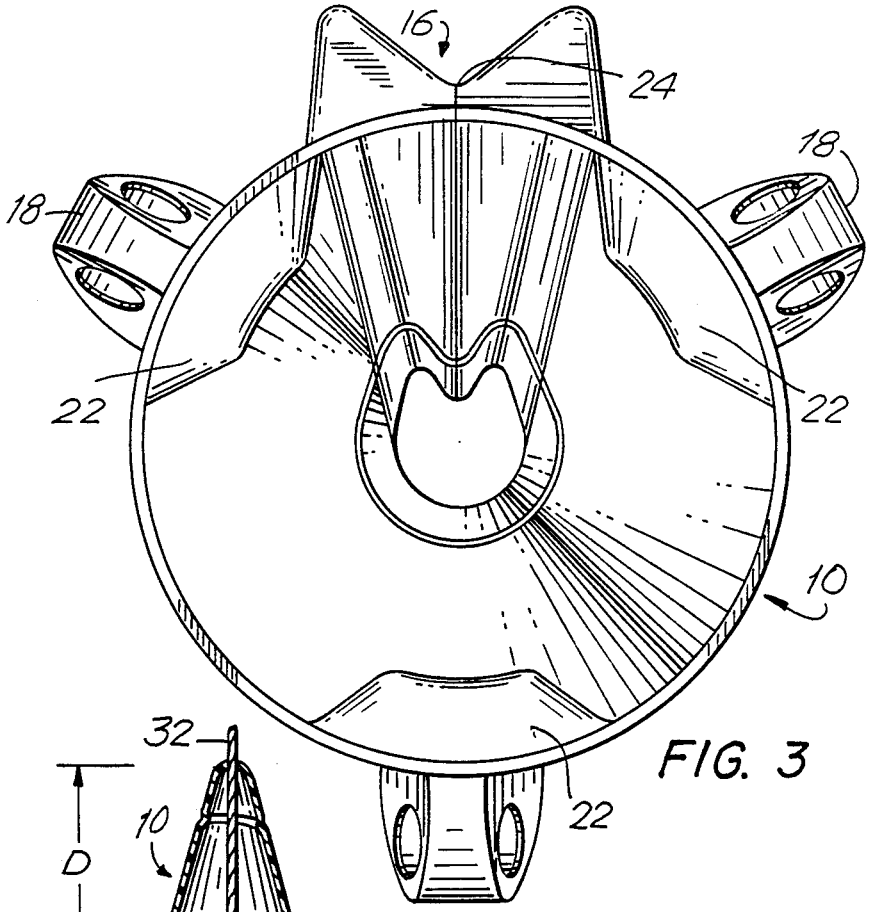
FIG. 3 is a view of the wildlife guard into its bottom or cylindrical section.

In FIG. 3 is depicted a view into and through the bottom or cylindrical section 14 of the wildlife guard 10. The V-shaped indentation 16 and slot 24, formed by cutting through the bottom of the indentation 16, are seen at the top of the figure. Longitudinal outward protrusions 18 and lateral inward protrusions 22 are also shown. The diameter of the roughly circular bottom edge of the wildlife guard 10 is on the order of four inches.

Figure 4:
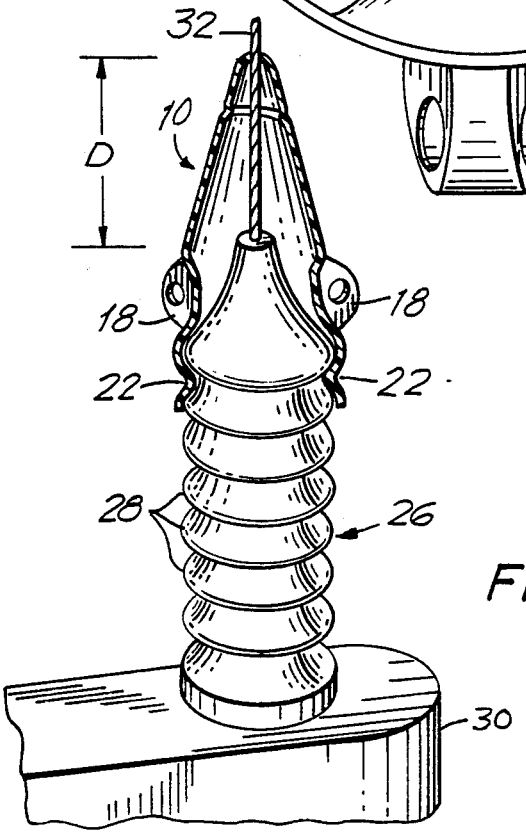
FIG. 4 is a sectional view of the wildlife guard installed atop an insulator bushing in the manner envisioned by its inventors.

FIG. 4 shows a partially cutaway view of the device deployed in the manner intended by its inventors. The wildlife guard 10 has been installed on top of an insulator bushing 26 which shields an energized electrical conductor 32. The bushing 26 is made up of a number of individual segments or skirts 28. The present invention is designed to fit bushings 26 whose diameters lie in the range from 3.25 to 4.25 inches.

A grounded cabinet 30 houses a transformer or other piece of electrical equipment. An electrically energized, and uninsulated or bare, conductor 32 emerges from the top of the wildlife guard 10. The use of such a guard 10 increases by a distance represented by D in the figure the amount a bird or small mammal, standing on the cabinet 30, must reach to contact the conductor 32. Thus, the likelihood of animal electrocution, and the serious consequent short circuits, power outages, and equipment damage, is greatly decreased. The distance D in this embodiment of the invention is on the order of eight inches.

The purpose of the lateral inward protrusions 22 can now be seen and easily described with reference to FIG. 4. during installation, as earlier described, the conductor 32 is popped through the slot 24 formed by the cut at the bottom of the V-shaped indentation 16. It is then pulled downward by the installer so that the inward protrusions 22 snap into the space below the topmost skirt 28. In such a way, the wildlife guard 10 is locked into a relatively fixed position on top of the insulator housing 26 and cannot be dislodged by an animal of the type it is designed to protect.

What is claimed is:

1. A wildlife guard for covering energized electrical conductors where they emerge from insulator bushings comprising:

a hollow shell of electrically insulating material having a first opening at one end of said shell to accommodate an electrical conductor;

a second opening at the other end of said shell to accommodate an electrical insulator bushing;

a longitudinal slot, connecting said first and second openings, through which an electrical conductor can be forced;

a plurality of inward protrusions to fit under the skirt of an insulator bushing; and a plurality of outward protrusions to be grabbed by a standard live-line tool during installation or removal.

2. A wildlife guard as described in claim 1 wherein said hollow shell is made of high-density polyethylene resistant to ultra-violet deterioration, cracking, and weather conditions.

3. A wildlife guard as described in claim 1 wherein said longitudinal slot is formed at the bottom of a longitudinal V-shaped indentation by making a cut along the bottom of said indentation.

4. A wildlife guard as described in claim 1 wherein said hollow shell has a frustoconical section and a generally cylindrical section integrally connected with one another.

5. A wildlife guard as described in claim 4 wherein said inward and outward protrusions are on the cylindrical section of said hollow shell.

6. A wildlife guard as described in claim 1 wherein said outward protrusions are longitudinally orientated.

7. A wildlife guard as described in claim 6 wherein said outward protrusions each has at least one hole for engagement with a standard live-line tool.

8. A wildlife guard as described in claim 1 wherein said inward protrusions are laterally orientated.

* * * * *